United States Patent [19]

Greenberg

[11] 4,335,538

[45] Jun. 22, 1982

[54] INFLATABLE OVERHEAD CRIB GYM TOY

[75] Inventor: Sheldon Greenberg, New York, N.Y.

[73] Assignee: Shelcore, Inc., South Plainfield, N.J.

[21] Appl. No.: 206,255

[22] Filed: Nov. 12, 1980

[51] Int. Cl.[3] ..... A63H 3/06; A63B 7/02; A63B 7/04

[52] U.S. Cl. ..... 46/88; 272/61; 272/112; 46/193

[58] Field of Search ..... 46/88, 87, 178, 180, 46/175 R, 1 R, 193, 89, 90; 272/112, 113, 130, 109, 61, 131, 136, 193

[56] References Cited

U.S. PATENT DOCUMENTS

| | | | |
|---|---|---|---|
| D. 144,582 | 4/1946 | Rassnick | 272/61 |
| D. 156,293 | 11/1949 | Tharler | 272/61 |
| 1,461,193 | 7/1923 | Larsen | 46/87 |
| 2,303,223 | 11/1942 | Murray et al. | 272/112 |
| 2,542,361 | 2/1951 | Roxburgh | 46/88 |
| 2,753,358 | 7/1956 | Stickley | 46/88 |
| 2,804,123 | 8/1957 | Kling | 46/87 |
| 4,147,344 | 4/1979 | Lee | 272/136 |

FOREIGN PATENT DOCUMENTS

| | | | |
|---|---|---|---|
| 2237420 | 2/1975 | France | 46/193 |

*Primary Examiner*—Robert Peshock
*Assistant Examiner*—Michael J. Foycik, Jr.
*Attorney, Agent, or Firm*—Kirschstein, Kirschstein, Ottinger & Cobrin

[57] ABSTRACT

An air-inflatable overhead crib gym toy encourages children to perform exercise-type manual movements with safety. The toy has an inflatable elongated tubular body in which a movable toy object is received, a pair of longitudinally-extending inflatable tubular extensions at opposite ends of the body, and a transversely-extending inflatable tubular projection which extends downwardly towards the child. A handle is swingingly supported from each extension. The movable object is visible through transparent side walls in the body, and is movable when the child grasps the handles, the projection, or any other part of the toy. Noisemakers are actuated when the child manipulates the toy. The inflated toy is soft and yieldable to the touch to protect the child from injury, and restores itself to its inflated condition when the child releases the toy from his grasp.

10 Claims, 2 Drawing Figures

2
72
12
64
26
48
32
16
14
58
54
52
56
18
34
28
50
10
66
A
2

A
72
12
64
70
68
30
48
26
60
34
32
16
24
22
14
58
54
38
62
36
52
40
42
56
18
44
46
28
50
10
64
A

INFLATABLE OVERHEAD CRIB GYM TOY

BACKGROUND OF THE INVENTION

1. Field of the Invention

The present invention generally relates to a children's toy and, more particularly, to overhead crib gym toys.

2. Description of the Prior Art

It is known to mount mobiles and like nursery toys on the upper part of a crib or play-pen, i.e., generally above the child, to both visually and auditorily attract the child's attention for amusement purposes. It is also known to use overhead crib-supported gym-type devices to encourage the child to manipulate the same and thereby develop muscular strength and coordination. Although the known crib-supported toys are generally satisfactory for their amusement and muscle development purposes, they have not proven to be altogether satisfactory. For example, the known crib-supported toys are generally made of injection-molded, hard plastic material which is not yielding to the touch, and some of which have sharp edges. Such a hard surface and/or sharp edges represent potential safety hazards, particularly for the active child who is readily prone to fall and impact on such hard plastic surfaces and/or sharp plastic edges.

SUMMARY OF THE INVENTION

1. Objects of the Invention

Accordingly, it is the general object of the present invention to overcome the aforementioned drawbacks of the prior art.

Another object of the present invention is to provide a crib-supported overhead nursery toy which has no sharp edges or hard surfaces on which a child can injure himself.

Still another object of the present invention is to provide an entertaining nursery toy which is safe to use even by the most active child.

A further object of the present invention is to provide a nursery toy which promotes the development of muscular strength and coordination for young children.

An additional object of the present invention is to provide a nursery toy which is both visually and auditorily appealing.

Yet another object of this invention is to provide an attractive nursery toy which provides great entertainment reward for children, particularly infants.

2. Features of the Invention

In keeping with these objects and others which will become apparent hereinafter, one feature of the invention resides, briefly stated, in a soft, inflatable, crib-supported, gym-type overhead nursery toy for encouraging children to perform exercise-type manual movements with safety. The toy comprises an air-inflatable tubular body constituted of thin plastic material, and having transparent wall portions which bound an interior main chamber. A toy object is mounted within the main chamber for movement therein when the inflated toy is subjected to manual movement.

The toy also comprises support means, i.e., straps, operatively connected to the tubular body for supporting the toy on a crib at a location above the child. Gym means, i.e., hand grips, are operatively connected to the tubular body and extend downwardly therefrom towards the child, for providing a handhold for the child to grasp so as to perform the exercise-type movements. An air-admitting means, i.e., an air-inlet valve, is provided on the tubular body for inflating the latter from a collapsed configuration to an inflated configuration. The toy object is visible through the transparent wall portions and is movable relative to the tubular body when the child manipulates the gym means in the inflated configuration of the toy.

In accordance with this invention, the inflated tubular body is soft and yieldable to the touch to protect the child from any injury during manipulation thereof. The inflated tubular body is self-restorable to the inflated configuration when the child ceases manipulation of the toy.

Hence, the soft, inflatable material of this toy protects the child in that there are no sharp edges or hard surfaces on which the child can be injured. Moreover, the handle grips and the squeezable material of the inflatable toy promotes the development of manual strength and coordination which is so vital to a child's proper development. The toy is highly entertaining and safe to use, even by the most active child.

In accordance with another feature of this invention, noisemaker means are provided within the toy for generating sounds when various parts of the toy are manipulated. This auditory appeal cooperates with the visual appeal contributed by the visible and movable toy objects, to provide a unique entertainment feature.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
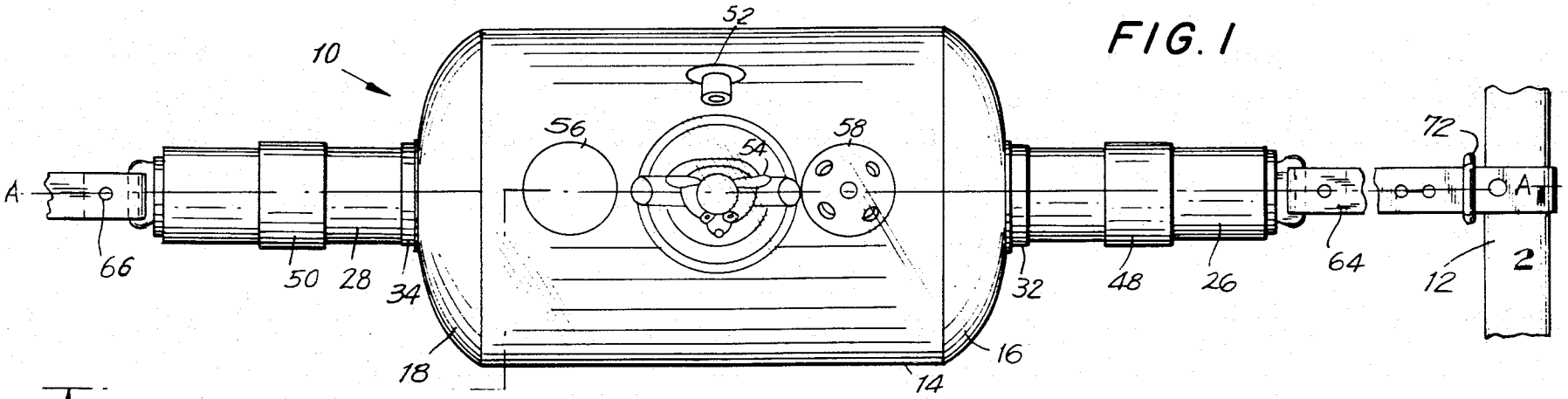
FIG. 1 is a partially broken-away top plan view of an inflatable, overhead, crib gym toy in accordance with this invention.

Reference numeral 10 generally identifies the soft, inflatable, gym-type nursery toy of this invention, which is useful for encouraging children, particularly infants, to develop their motor skills by performing exercise-type manual movements on the toy by children playing with the same. The toy 10 is supported across the upper regions of a crib, preferably by being generally tautly suspended between the opposite side rails of the crib, above the child. As shown in the drawings, reference numeral 12 generally identifies one side rail of the crib; the opposite side rail having been omitted for purposes of clarity. It will be expressly understood that the term "crib", as used throughout this specification and the claims, is intended to include any bedstead, such as a crib, or cradle, as well as a playpen.

The toy 10 comprises an air-inflatable, tubular central cylindrical body 14, which is elongated along an axis of symmetry A—A, and a pair of air-inflatable dome-shaped end portions 16, 18 at opposite axial ends of the tubular body 14. The body 14 and end portions 16, 18 are made of thin, sheet-type plastic material, such as polyvinyl chloride. The body 14 is preferably constituted of transparent material, whereas the end portions 16, 18 are preferably opaque. The transparent wall portions of the body 14 bound an interior main chamber 20.

At each axial end of the body 14, an annular portion is bent inwardly to form a generally radially-extending lip portion 22. Similarly, the annular portion of each dome-shaped end portion 16, 18 is bent inwardly to form a generally radially-extending base portion 24. The corresponding lip portions 22 and base portions 24 are thereupon overlapped and joined together by any joining technique, e.g., heat fusion, to securely and air-tightly interconnect the body 14 to each dome-shaped end portion 16, 18 without forming any sharp exterior edges at this junction, that might otherwise cause a safety hazard.

A pair of air-inflatable, axially-extending tubular extensions 26, 28 are connected on, and extend outwardly of, the dome-shaped end portions 16, 18. Each extension is made of opaque, sheet-type plastic material, and is preferably heat-fused to its respective dome-shaped end portion, with the aid of a thin plastic reinforcing collar 32. Each extension bounds an interior compartment 390 which is in air-communication with the main chamber 20 via opening 34 formed at the exterior axial end of each dome-shaped end region 16, 18. Each collar 32 not only strengthens the junction between the respective extension and its associated dome-shaped end portion, but also provides a smooth exterior surface to protect a child from injury.

An air-inflatable, radially-extending, tubular projection 36 is located on the body 14 generally centrally intermediate the end regions 16, 18. The projection 36 extends downwardly towards the child, and is dimensioned such that its cross-section can be grasped within the palm of an average child's hand. The projection 36 is made of opaque, sheet-type plastic material and is preferably heat-fused to the body 14 with the aid of a thin plastic reinforcing collar 38. The collar 38, like the collar 32, strengthens the junction between the projection 36 and the body 14, and also smooths the exterior surface of this junction. The projection 36 bounds an interior space 40 which is in air-communication with the main chamber 20 via opening 42, that is formed in a center region of the tubular body 14.

A pair of handles 44, 46 are supportably suspended from each extension 26, 28 by support members 48, 50. Each handle 44, 46 is constituted of plastic material, and has a generally rectangular handhold, which is dimensioned to be graspable by the average child's hand. Each support member 48, 50 is heat-fused to its respective plastic handle. The opposite end of each support member 48, 50 is looped around its respective extension, and heat-fused thereto in order to secure the position of the handles relative to the tubular body 14. The strip-shaped support members 48, 50 support the handles 44, 46 for swinging movement.

An air-admitting inlet valve 52 is provided on the body for inflating the toy from an initially collapsed configuration to an inflated configuration. In the collapsed configuration, the body 14, the extensions 26, 28 and the projection 36 are all deflated to permit the toy to be folded-up and stored, as desired, in a minimal amount of space. In the inflated configuration, the body 14, the extensions 26, 28 and the projection 36 are all inflated to form a shape-retaining, T-shaped structure.

Figure 2:
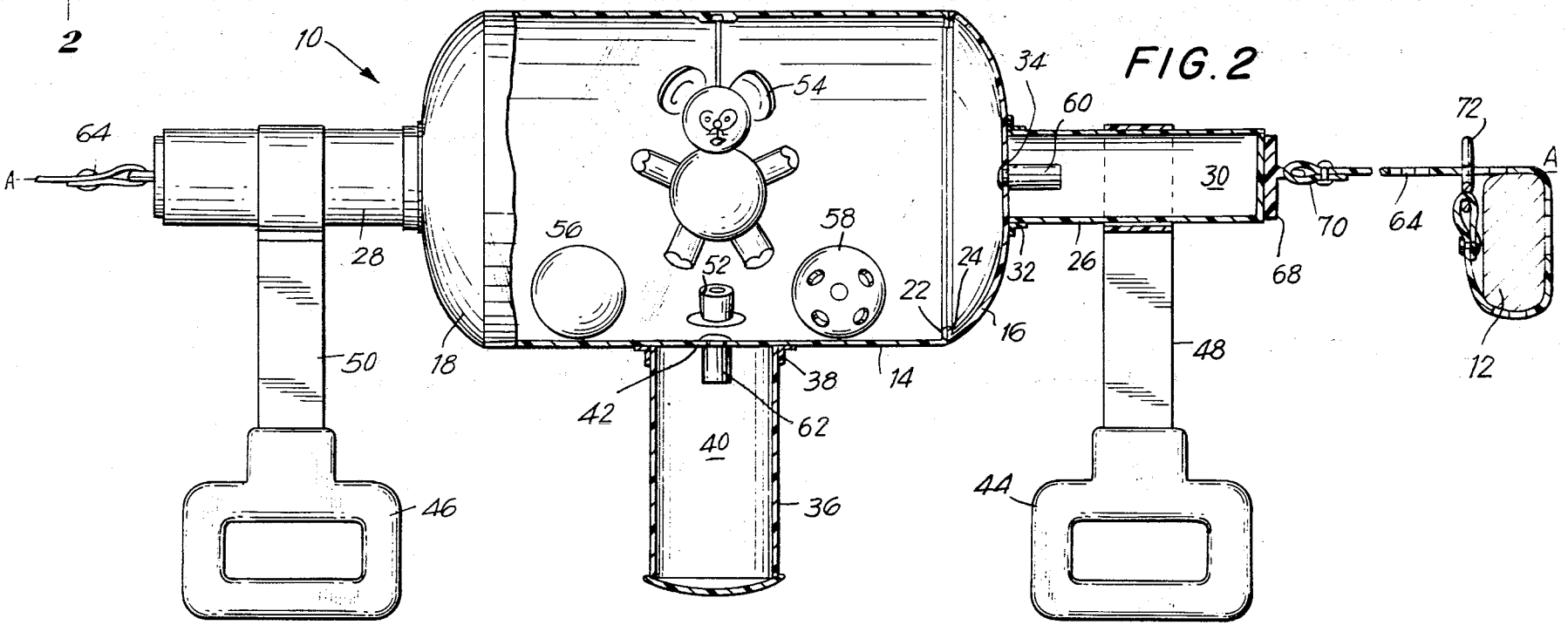
FIG. 2 is a vertical sectional view as taken along the line 2—2 of FIG. 1.

As best shown in FIG. 2, the extensions 26, 28 and the projection 36 are approximately of equal size and volume, whereas the body 14 is larger and bounds a volume which is approximately larger than the combined volume of the two extensions and projection.

The toy objects 54, 56, 58 are mounted within the main chamber 20 for movement relative to the body 14. The toy objects are visible through the transparent wall portions of the body 14. The toy object 54 is an animal-like mobile figure, which is suspended by a plastic strip from the top of the tubular body 14 to permit a swinging movement of the figure 54. The figure 54 is preferably a three-dimensional figurine, which is filled with foam and covered by sheet plastic material. The toy object 56 is a ball mounted for free-rolling movement within the chamber 20. The toy object 58 is a ball analogous to ball 56, but also includes noise-making elements, such as bells within the ball 58, which generate sounds when the ball 58 is disturbed.

Noise-maker means 60, 62 are located within each opening 34, 42 to generate sounds whenever the extensions or projection are squeezed. Specifically, the noise-maker means are whistle-type devices whose input openings face towards the compartment 30, and whose output openings face towards the main chamber 20. Any squeezing of the extensions 26, 28 will force air through its respectively-associated whistle device, and cause the whistle to sound when the air moves through the same, and vibrates its reed.

The handles 44, 46 and the projection 36 all extend downwardly towards the child, for a distance sufficient to be within the reach of the child's outstretched arm. To this end, an adjustable supporting means or adjustable belts 64, 66 are provided at the far end of each extension 26, 28. Each adjustable belt comprises an annular plastic flange 68, which is heat-fused on its entire planar surface to the far annular end of each extension. A belt loop 70 is connected to each flange 68. The belt 64 has a plurality of spaced-apart notches, one of which is selected as desired by the hook 72 after the opposite end of the belt has been looped around the side rail 12 of the crib. Each adjustable belt is detachably connected to the crib simply by unhooking the hook 72 from its belt. The belts on either side of the inflatable toy are adjusted to generally tautly suspend the toy in order to reliably support the child in the event that he lifts himself up by pulling on the toy.

The handles 44, 46 and projection 36 all constitute gym means for encouraging the child to grip them and perform exercise-type manual movements. For example, the child can pull down on the handles and lift his body, or can grip or squeeze the projection 36, or can grip or squeeze the extensions 26, 28. Any of these movements, or combinations thereof, will cause the objects 54, 56, 58 to move, and/or the noise-maker means 60, 62 to sound. These visual and auditory actions contribute to the child's entertainment, and encourage him to continue further with the performance of the exercise-type movements.

The inflated toy 10 is soft and yieldable to the touch due to its all-plastic construction and its air-inflated condition. The inflated toy restores itself to its inflated configuration, even after the child squeezes or otherwise manipulates any portion thereof. For example, any air squeezed out of compartment 30 to sound the noise-maker 60 and forced into chamber 20, will return in the opposite direction through the noise-maker 60, to restore the toy to its originally unstressed state. As noted above, the inflated toy preferably is constituted of a plastic material preferably polyvinyl chloride.

It will be understood that each of the elements described above, or two or more together, may also find a useful application in other types of constructions differing from the types described above.

While the invention has been illustrated and described as embodied in an inflatable overhead crib gym toy, it is not to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A soft, inflatable, crib-supported, gym-type, overhead nursery toy for encouraging children to perform exercise-type manual movements with safety, comprising:

(a) an air-inflatable tubular body constituted of thin plastic material, said tubular body having transparent wall portions bounding an interior main chamber, said tubular body being elongated along a longitudinal axis of symmetry and having opposite axial ends;

(b) a pair of axially-extending, air-inflatable tubular extensions each located at a respective axial end of the tubular body, each extension being constituted of thin plastic material wall portions which bound an interior compartment that is in air communication with the main chamber of the tubular body;

(c) a radially-extending, air-inflatable tubular projection intermediate the axial ends of the tubular body, said tubular projection being constituted of thin plastic material wall portions which bound an interior space that is in air communication with the main chamber of the tubular body;

(d) a toy object mounted within the main chamber for movement relative to the tubular body when the inflated toy is subjected to manual movement;

(e) gym means connected to each extension and extending generally radially downwardly towards the child, for providing a handhold for each extension for the child to grasp and thereby perform the exercise-type movements; and (f) air-admitting means on the tubular body, for inflating the tubular body, the tubular extensions and the tubular projection from a collapsed configuration in which the deflated body, extensions and projection can be stored, to an inflated configuration in which the toy object is visible through the transparent wall portions and movable relative to the tubular body when the child grabs the gym means and manipulates the toy, said inflated body, extensions and projection being soft and yieldable to the touch to protect the child from any injury during manipulation of the toy, and being self-restorable to said inflated configuration when the child ceases said manipulation.

2. The nursery toy as defined in claim 1; and further comprising noisemaker means in the air path between the interior space and the main chamber, and between each interior compartment and the main chamber, for generating sound when the extensions and the projection are manipulated.

3. A soft, inflatable, crib-supported, gym-type, overhead nursery toy for encouraging children to perform exercise-type manual movements with safety, comprising:

(a) an air-inflatable tubular body constituted of thin plastic material, said tubular body having transparent wall portions bounding an interior main chamber;

(b) a toy object mounted within the main chamber for movement relative to the tubular body when the inflated toy is subjected to manual movement;

(c) support means operatively connected to the tubular body, for supporting the overhead toy on a crib at a location above the child;

(d) gym means operatively connected to the tubular body and extending downwardly therefrom towards the child, for providing a handhold for the child to grasp and thereby perform the exercise-type movements; and (e) air-admitting means on the tubular body, for inflating the latter from a collapsed configuration in which the deflated body can be stored, to an inflated configuration in which the toy object is visible through the transparent wall portions and movable relative to the tubular body when the child manipulates the gym means, said inflated tubular body being soft and yieldable to the touch to protect the child from any injury during manipulation of the toy, and being self-restorable to said inflated configuration when the child ceases said manipulation.

4. The nursery toy as defined in claim 1, wherein the tubular body is elongated along a longitudinal axis of symmetry; and wherein the toy further comprises a pair of axially-extending, air-inflatable tubular extensions at opposite axial ends of the tubular body, each extension being constituted of thin plastic material wall portions which bound an interior compartment that is in air communication with the main chamber of the tubular body.

5. The nursery toy as defined in claim 4, wherein the gym means includes a manually-grippable handle swingingly suspended from each extension.

6. The nursery toy as defined in claim 4; and further comprising noisemaker means in the air path between each interior compartment and the main chamber, for generating sound when the extension is manipulated.

7. The nursery toy as defined in claim 1, wherein the gym means includes a radially-extending, air-inflatable tubular projection intermediate the axial ends of the tubular body, said tubular projection being constituted of thin plastic material wall portions which bound an interior space that is in air communication with the main chamber of the tubular body.

8. The nursery toy as defined in claim 7; and further comprising noisemaker means in the air path between the interior space of the projection and the main chamber, for generating sound when the projection is manipulated.

9. The nursery toy as defined in claim 1, wherein the toy object is mounted for overhead swinging movement within the main chamber.

10. The nursery toy as defined in claim 1, wherein the toy object is mounted for rolling movement within the main chamber.

* * * * *